United States Patent [19]

Mendenhall et al.

[11] Patent Number: 4,515,586

[45] Date of Patent: May 7, 1985

[54] POWDER SYRINGE MIXING SYSTEM

[75] Inventors: Douglas W. Mendenhall, Libertyville; Ping Li, Waukegan, both of Ill.

[73] Assignee: Abbott Laboratories, North Chicago, Ill.

[21] Appl. No.: 445,399

[22] Filed: Nov. 30, 1982

[51] Int. Cl.[3] ..... A61J 1/00

[52] U.S. Cl. ..... 604/87; 604/89; 604/92; 604/416

[58] Field of Search ..... 604/56, 82, 87–89, 604/90–92, , 410, 416, 415, 244, 403, 414

[56] References Cited

U.S. PATENT DOCUMENTS

| | | | |
|---|---|---|---|
| 2,590,900 | 4/1952 | Sommerstein | 604/415 |
| 2,721,552 | 10/1955 | Nosik | 604/416 |
| 3,875,012 | 4/1975 | Dorn et al. | 604/415 |
| 4,048,999 | 9/1977 | Köbel | 604/90 |
| 4,059,112 | 11/1977 | Tischlinger | 604/413 |
| 4,089,432 | 5/1978 | Crankshaw et al. | 604/415 |
| 4,172,457 | 10/1979 | Choksi et al. | 604/416 |
| 4,289,648 | 9/1981 | Hoskins et al. | 604/416 |
| 4,405,317 | 9/1983 | Case | 604/90 |
| 4,412,836 | 11/1983 | Brignola | 604/87 |
| 4,417,890 | 11/1983 | Dennehey et al. | 604/256 |

*Primary Examiner*—C. Fred Rosenbaum
*Assistant Examiner*—Michelle Lester
*Attorney, Agent, or Firm*—Alan R. Thiele; Martin L. Katz

[57] ABSTRACT

A pre-filled chamber having a piston plug at one end and a stopper at the other end. The chamber is filled with a powdered medicament that is to be intermixed with a diluent in a container. Rotatable attachments join the chamber containing the powder with a receptacle on the container. The powdered medicament is expelled from the chamber by the force of a plunger acting on the piston plug. The stopper at the end of the chamber containing the powder serves as a mounting for a piercing tip which breaks a membrane over the neck of the container allowing fluid connection between the chamber and the container and transferral of the powdered medicament from the chamber to the container.

8 Claims, 4 Drawing Figures

POWDER SYRINGE MIXING SYSTEM

BACKGROUND OF THE INVENTION

Many drugs, such as sodium Pentothal as manufactured and sold by Abbott Laboratories and a wide variety of antibiotics as manufactured by other pharmaceutical companies, are stored in powdered lyophilized form and must be mixed with a liquid such as sterile water, glucose or normal saline immediately prior to use. This pre-use mixing is necessary as some medicaments lose their potency or strength when stored with a diluent over a long period of time.

The concept of mixing a wet diluent and a dry powder within the barrel of a syringe or vial has been known in the past. The developments in this area have ranged from the very complex to the very simple. Indicative of the very complex means is the Choski U.S. Pat. No. 4,243,080. In this patent, two plungers and a venting system are used. Manually removed closures separate the two components to be mixed. The Choski U.S. Pat. No. 4,243,080 also describes screw and pressure means which facilitate the mating of parts containing the medicaments to be mixed. Venting is provided to release the pressures built up by the mixing of medications. The complexity of operation increases the cost of manufacture and similarly increases the possibility of failure. It is these two problems that the present invention seeks to avoid. In contrast, the Kobel U.S. Pat. No. 4,048,999 and the Kobel U.S. Pat. No. 4,153,057 are representative of simpler means to combine two medicaments or combine a medicament with a diluent. In the Kobel '999 patent, the entire mixing system is described, while in the Kobel '057 patent, only the unique design of the stopper used in the U.S. '999 patent is disclosed. These two Kobel patents describe a stoppered stopper. Operation of the mixing system is effected by dislodging a small stopper within a bore of a main stopper. The small stopper, when dislodged from the bore of the main stopper, creates an open channel for passage of diluent into a powder. Proper dilution of powdered medicament such as with antibiotics administered intravenously requires the use of large, high volume syringes. The size of these syringes greatly increases the cost and difficulty of use by health care personnel. If the high volume syringe were replaced with a series of smaller syringes to decrease the difficulty of use, the exposure to a nonsterile environment would rapidly increase. The present invention overcomes these difficulties. Between the complexity of the Choski '080 patent and the simplicity of the Kobel '999 and '057 patents is the Tischlinger U.S. Pat. No. 4,059,112. While describing a means of using an additive syringe with a container, the '112 patent discloses only a frictional fit nozzle member with a container. This patent discloses force exerted on the liquid diluent rather than the powder medicament. The complexity of manufacture of this device reduces the ability to maintain a sterile environment. Careful packaging and shipping are also very critical to maintaining operability of the device disclosed in the '112 patent, as the integrity of the diaphragm holding the diluent in its storage chamber is critical to the successful operation of this device. Furthermore, as with the devices claimed in the Kobel '999 and '057 patents a large volume syringe would be required to obtain proper dilution. The presently disclosed invention overcomes these problems by placing powder in a chamber member and allowing for separation of the plunger mechanism from the diluent and medicament containers. In this manner, any chance of accidental activation is avoided. Additionally, a wide variety of solution concentrations are possible by the use of containers of diluent covering a broad range of volumes.

SUMMARY OF THE INVENTION

The present invention relates to a system for mixing wet and dry drug components that is very simple to operate and does not require a complex arrangement of internal components.

The system includes a liquid container such as a glass vial, a flexible intravenous bag or a semi-rigid container with an internal rotatable element and a rupturable diaphragm in a neck portion to maintain sterility of the liquid contents of the container. Powdered medicament is stored in a sterile manner in the vial or chamber member with a piston plug slidably mounted in sealing engagement in the vial at one end and a sealing stopper at the other end with the medicament therebetween. An external rotatable attachment element extends from the chamber adjacent the sealing stopper. When intermixing of a dry medicament within the chamber member with a diluent in the container is desired, the membrane may be pierced and the powdered medication inserted into the diluent. The chamber member is attached to the container by the internal and external rotatable attachment means which are in the form of threads. A channel for fluid communication between the vial and the container is effected when the sealing membrane is pierced. Activation of the system is by insertion of a plunger into the chamber member. This action of the plunger forcibly urges the powdered medicament into the container where it is intermixed with the diluent. Shaking the diluent container or gently massaging the walls of a flexible container will render the solution ready for intravenous administration through a standard hypodermic needle or catheter.

DESCRIPTION OF THE DRAWING

A further understanding of the advantages and operation of the invention may be had by reference to the following drawing wherein.

DESCRIPTION OF THE EMBODIMENTS

Figure 1:
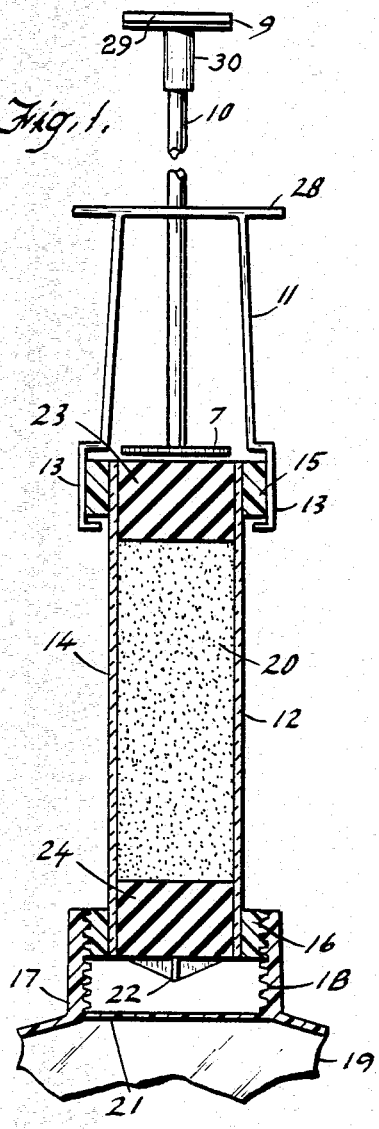
FIG. 1 is a front elevational view in partial vertical section of the syringe mixing system.

FIG. 1 illustrates the vial or chamber member 12 positioned for use with container 19. Detachable plunger assembly 11 has been attached to shoulder 15 of chamber member 12 by manually sliding ears 13 over annular shoulder 15. Screw connector 16 serves as an external rotatable attachment means for vial 12 and is rotatably engaged with complementary screw receptacle 18 in container neck 17 which serves as an internal rotatable attachment means. Operation as will be further described herein will be initiated by the application of axial force on plunger 10. Until axial force is exerted by means of plunger assembly 11, piston plug 23 and end stopper 24 are slidably mounted in chamber member 12 to define a cavity within the central portion 14 of chamber member 12 for containment of powder 20. The piercing tip 22 as represented by four right triangles having their base legs formed on perpendicular diameters of a circle and oriented such that the plane of the triangles is perpendicular to the plane of the circle is attached to a stopper 24 which serves both as a sealing means and is used to pierce and subsequently puncture pierceable membrane 21 which closes container neck 17 of container 19.

Figure 2:
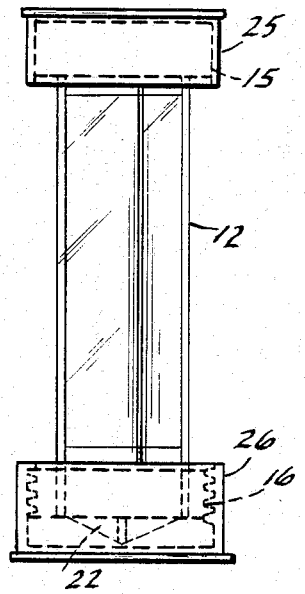
FIG. 2 is a side elevational view of the vial or chamber member of the syringe mixing system of FIG. 1 before insertion into the container and mounting of the plunger assembly. Caps have been placed over the ends of the chamber member for sterility.

FIG. 2 is the chamber member of FIG. 1 as it is supplied to health care personnel and as it would appear just before use. Caps 25 and 26 are placed over shoulder 15 and screw connector 16, respectively, to provide a sterile environment for mating surfaces until time for use.

Figure 3:
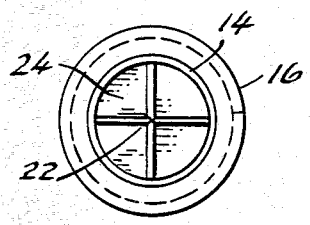
FIG. 3 is an end view of the chamber member shown in FIG. 2 as viewed from the bottom and with the cap removed.

FIG. 3 is an end view of the chamber member 12 showing the piercing tip 22 in concentric proximity to screw connector 16 and central portion 14 of chamber member 12.

Figure 4:
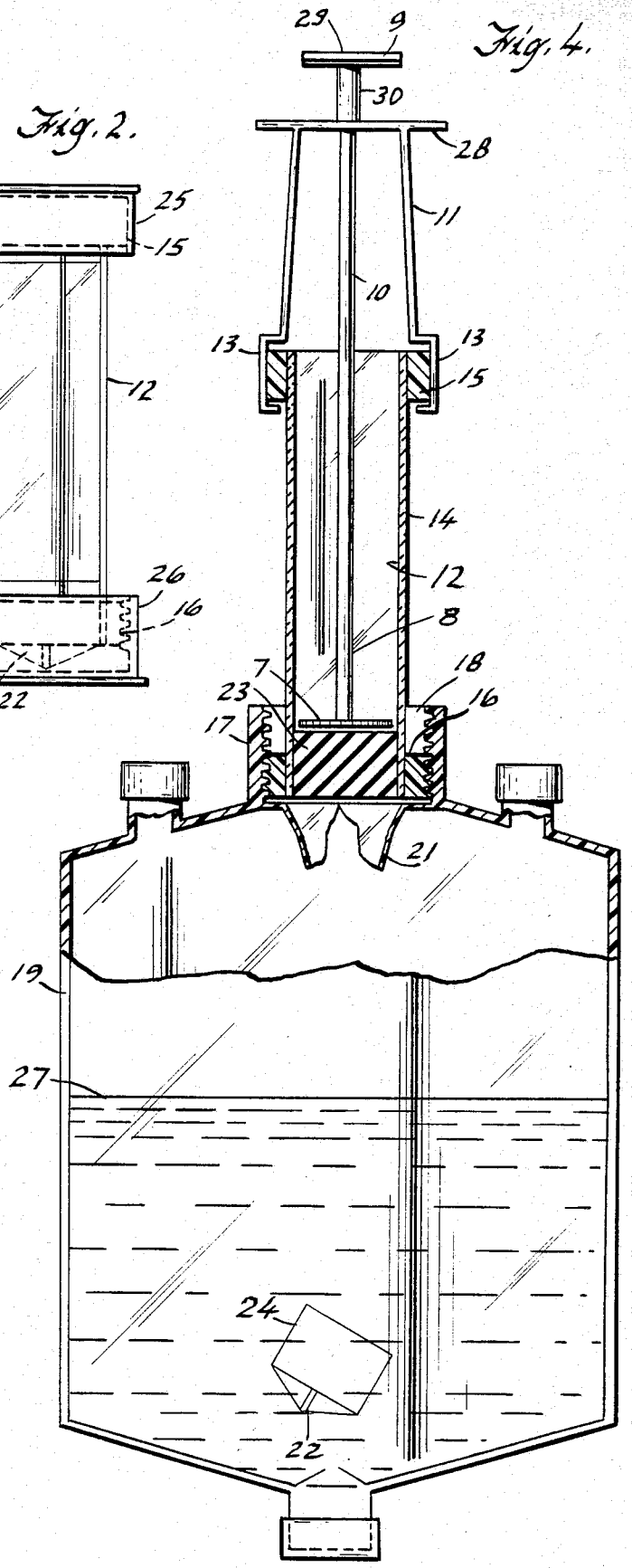
FIG. 4 is a front elevational view in partial section of the syringe mixing system of FIG. 1 wherein the medicament has been transferred into said container.

FIG. 4 illustrates the chamber member 12 after expulsion of the contents into container 19. Plunger assembly 11 has been activated by the application of axial force and medicament 20 has passed into diluent 27 in container 19.

DESCRIPTION OF OPERATION

The chamber member 12 will be packaged and supplied in a sterile condition as shown in FIG. 2. When it is desired to mix medicament 20 with diluent 27, caps 25 and 26 will be removed exposing piston plug 23 and end stopper 24. Plunger assembly 11 is secured over shoulder 15 by sliding ears 13 over shoulder 15 and moving plunger 10 by the exertion of axial force until it contacts piston plug 23. The screw connector 16 on the chamber member 12 is threadably engaged with screw receptacle 18 on the container 19. Complete travel of externally threaded shoulder 16 over internally threaded neck 18 by rotating member 12 will cause piercing tip 22 to pierce membrane 21. The powder syringe is now in place for transferral of medicament 20 into diluent 27. Operation of the system to effect transferral of medicament 20 into diluent 27 is begun by exerting axial force on second surface 9 of thumb flange 29 by thumb pressure thereon and opposing finger pressure on flange 28. Extended shaft 8 transmits the axial force to piston 7 of plunger 10 which force is stabilized by ears 13 and flange 28. Powder 20 transmits the axial force exerted by plunger 10 on piston plug 23 to end stopper 24. In the alternative a rigid rod fabricated from glass or inert plastic could be used in place of plunger assembly 11. This axial force causes piston plug 23 to move into central portion 14 of chamber member 12. Powder 20 is similarly displaced toward end stopper 24. End stopper 24 is urged out of central portion 14 of chamber member 12. Continued application of axial force on plunger 10 will cause end stopper 24 to pass through screw receptacle 18 allowing powder 20 to pass into the diluent 27 within container 19. Collar 30 of thumb flange 29 will come to rest on flange 28 when all medicament 20 has been expelled into container 19. Piston plug 23 remains in chamber member 12.

In a preferred embodiment, chamber member 12 is made of glass. However, inert plastics which do not affect the powdered medicament 20 may also be used. Shoulders 15 and 16 of chamber member 12 are fabricated from polypropylene or the same plastic which may be used to form chamber member 12. If chamber member 12 is made of glass, shoulders 15 and 16 may also be formed from glass. Stopper 24 and piston plug 23 may be made of a type of natural rubber that is compatible with the contained powdered medicament. A plastic material is not chosen because of the possibility of reacting with the powdered medicament. Plunger assembly 11 may be fabricated from either a plastic or metal material so that it may be used repeatedly. Container 19 is a flexible, semi-rigid or rigid container. Piercing point 22 is formed separately from a hard plastic which will not contaminate the mixed medication 20 and 27. The exact shape and size of the piercing point 22 has been determined not to be a critical feature as long as the piercing point 22 presents a sufficiently sharp surface to membrane 21 so that a tear or rupture will be effected with the application of axial force by the piercing point 22 against the membrane 21. It is secured to stopper 24 by a suitable cement plastic welding technique or mechanical fitment means. Additionally, the size of piercing point 22 should be such so as to not inhibit operation of the mixing system. While piercing point 22 facilitates use of the disclosed device, removal of piercing point 22 will not defeat operability.

It will thus be seen that the invention disclosed herein provides a mixing system that is easy to manufacture, can be readily disassembled for storage and shipping, then reassembled prior to use with a minimum of difficulty for use with a wide range of diluent types and quantities.

In the foregoing specification, specific embodiments have been used to describe the invention. It is understood that those skilled in the art can make certain modifications to these embodiments without departing from the spirit and scope of the invention.

I claim:

1. A mixing system for first storing and subsequently transferring a powdered medicament to a solution container comprising:

a hollow chamber member;

a piston plug slidably mounted in sealing engagement with one end of said hollow chamber member;

a stopper member slidably mounted in the opposite end of said hollow chamber member from said piston plug, said stopper member having a piercing tip on one side thereof;

external rotatable engagement means extending from said hollow chamber member substantially adjacent said stopper member;

complementary internal rotatable engagement means in the neck portion of the solution container;

removable means for exerting force on said piston plug in a direction substantially parallel to the axis of said hollow chamber member;

a rupturable diaphragm positioned in the neck portion of the solution container so that rotatable engagement of said external and internal rotatable engagement means will cause said piercing tip to rupture said pierceable diaphragm;

whereby the exertion of force on said piston plug by said removable means for exerting force after the rupturing of said rupturable diaphragm by said piercing tip will effect a transfer of the powdered medicament from said hollow chamber member into the solution container.

2. The syringe mixing system as defined in claim 1 wherein the ends of the hollow chamber member are covered by sealing caps.

3. The mixing system as defined in claim 1 wherein said hollow chamber member is formed from plastic material.

4. The mixing system as defined in claim 1 wherein the rotatable engagement means are threads.

5. The mixing system as defined in claim 1 wherein the removable means for exerting force on said piston plug in a direction substantially parallel to the axis of said chamber member comprises a plunger assembly.

6. A plunger activated vial for first storing and subsequently transferring a powdered medicament to a solution container having an internal rotatable attachment element and a rupturable diaphragm in a neck portion, said plunger activated vial comprising:

a hollow chamber member;

piston plug slideably mounted in sealing engagement with said hollow chamber member;

a stopper member slidably mounted in sealing engagement with the opposite end of said hollow chamber member from said piston plug, said stopper member defining a piercing tip;

an external rotatable attachment element extending from said hollow chamber member substantially adjacent said stopper member, said external rotatable attachment element being complementary to the internal rotatable attachment element of the solution container so that rotatable interengagement of the rotatable attachment elements will cause said piercing tip to rupture said diaphragm; and a plunger assembly comprising:

means for attaching said plunger assembly to said hollow chamber member adjacent said piston plug;

a piston member constructed and arranged to contact said pushing plug;

a pushing surface constructed and arranged for the application of manual force;

a shaft member connecting said piston member and said pushing surface;

whereby upon the application of manual force on said pushing surface of said plunger assembly in the direction of said hollow chamber member, after the rupturing of the diaphragm by the piercing tip, said piston member will cause the movement of said piston plug into said hollow chamber member and cause said powdered medicament to be transferred into the solution container.

7. The plunger-activated vial as defined in claim 6 wherein said external rotatable attachment is defined by threads.

8. The plunger activated vial as defined in claim 6 wherein said piercing tip is formed separately from said stopper member.

* * * * *